US009387678B2

(12) United States Patent
Kobayashi

(10) Patent No.: US 9,387,678 B2
(45) Date of Patent: Jul. 12, 2016

(54) LIQUID DROPLET INJECTION APPARATUS AND METHOD FOR RECOVERING NOZZLE OF LIQUID DROPLET INJECTION APPARATUS

(71) Applicant: Konica Minolta, Inc., Tokyo (JP)

(72) Inventor: Ryohei Kobayashi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/308,234

(22) Filed: Jun. 18, 2014

(65) Prior Publication Data

US 2015/0077466 A1 Mar. 19, 2015

(30) Foreign Application Priority Data

Jun. 24, 2013 (JP) ..... 2013-131602

(51) Int. Cl.
*B41J 2/165* (2006.01)

(52) U.S. Cl.
CPC ..... *B41J 2/1652* (2013.01); *B41J 2/16526* (2013.01); *B41J 2/16585* (2013.01); *B41J 2002/1657* (2013.01)

(58) Field of Classification Search
CPC .. B41J 2/1652; B41J 2/16526; B41J 2/16585; B41J 2002/16529; B41J 2002/16597; B41J 2002/16591
USPC ..... 347/22–23, 35
See application file for complete search history.

(56) References Cited

U.S. PATENT DOCUMENTS 5,625,384 A * 4/1997 Numata et al. ..... 347/23
6,079,809 A * 6/2000 Yaegashi et al. ..... 347/35
8,356,880 B2 * 1/2013 Hirosawa et al. ..... 347/30
8,430,479 B2 * 4/2013 Nishida ..... 347/29
2002/0101472 A1 8/2002 Tsuboi et al.
2006/0109300 A1 5/2006 Tsuboi et al.
2008/0186341 A1 8/2008 Hirato
2009/0073214 A1 * 3/2009 Tojo et al. ..... 347/19
2010/0103233 A1 * 4/2010 Akatsuka et al. ..... 347/92

(Continued)

FOREIGN PATENT DOCUMENTS

EP 0704307 A2 4/1996
EP 1205307 A2 5/2002

(Continued)

OTHER PUBLICATIONS

Extended European Search Report corresponding to Application No. 14172584.6-1701/2837498; Date of Mailing: Apr. 28, 2015.

*Primary Examiner* — Jannelle M Lebron
*Assistant Examiner* — Jeremy Bishop
(74) *Attorney, Agent, or Firm* — Cantor Colburn LLP

(57) ABSTRACT

A liquid droplet ejection apparatus including a head 1 in which a plurality of ink chambers 11 are aligned in one or both of an X direction and a Y direction, liquid droplets are ejected from nozzles 12, and printing is carried out in a print region of a recording medium based on print data, wherein the ink contains a dispersion medium and solid particles having higher specific gravity than that of the dispersion medium, and the liquid droplet ejection apparatus includes a flushing device that performs a flushing operation when the head 1 is present in a non-print region in such a manner that an amount of liquid droplets ejected from the nozzle 11*b* placed at an end portion in an alignment direction becomes larger than an amount of liquid droplets ejected from the nozzle 11*a* placed in a central portion in the alignment direction.

20 Claims, 9 Drawing Sheets

(56) References Cited

U.S. PATENT DOCUMENTS

| | | | | |
|---|---|---|---|---|
| 2010/0277523 | A1 | 11/2010 | Nishikawa | |
| 2011/0148965 | A1* | 6/2011 | Taira et al. | 347/14 |
| 2011/0211018 | A1 | 9/2011 | Hirosawa et al. | |
| 2014/0152725 | A1* | 6/2014 | Tomizawa et al. | 347/9 |
| 2014/0152730 | A1* | 6/2014 | Sato et al. | 347/14 |
| 2014/0292869 | A1* | 10/2014 | Mizutani et al. | 347/14 |

FOREIGN PATENT DOCUMENTS

| | | | |
|---|---|---|---|
| EP | 1955849 | A2 | 8/2008 |
| EP | 2500173 | A1 | 9/2012 |
| JP | H04-128049 | B2 | 4/1992 |
| JP | 2000203020 | A | 7/2000 |
| WO | 2009077790 | A1 | 6/2009 |

* cited by examiner

FIG.10
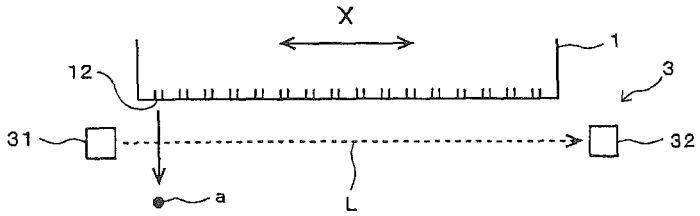
FIG. 11
| | LESS THAN 5% | 5% OR MORE AND LESS THAN 10% | 10% OR MORE |
|---|---|---|---|
| END PORTION | 100 PULSES | 150 PULSES | 200 PULSES |
| CENTRAL PORTION | 50 PULSES | 75 PULSES | 100 PULSES |
FIG. 12
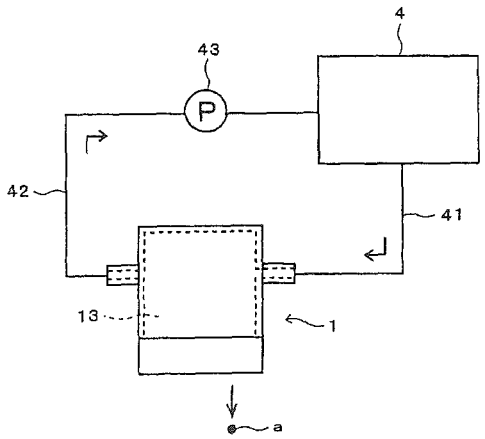

LIQUID DROPLET INJECTION APPARATUS AND METHOD FOR RECOVERING NOZZLE OF LIQUID DROPLET INJECTION APPARATUS

CROSS REFERENCE TO RELATED APPLICATIONS

The present invention claims priority under 35 U.S.C. §119 to Japanese Application No. 2013-131602 filed Jun. 24, 2013, the entire content of which is incorporated herein by reference.

TECHNICAL FIELD

The present invention relates to a liquid droplet ejection apparatus and a method for recovering a nozzle of the liquid droplet ejection apparatus, and more particularly to a liquid droplet ejection apparatus that can suppress sedimentation of solid particles contained in an ink and stably eject liquid droplets for a long time and a method for recovering a nozzle of the liquid droplet ejection apparatus.

BACKGROUND

A liquid droplet ejection apparatus that performs printing by ejecting liquid droplets from a head is generally used for various industrial purposes as an inkjet printer. Applications of this industrial inkjet increases year by year, and the inkjet printer is used for not only performing printing on paper sheets, fabric, plastic sheets, and others but also performing printing of a design on a surface of a ceramic tile in recent years. Accordingly, performance that enables stably ejecting various kinds of inks for a long time has been demanded with respect to the liquid droplet ejection apparatus.

However, in case of performing printing by using as an ink a ceramic ink containing solid particles of ceramics or a white ink containing solid particles of a titanium oxide or the like as a pigment and ejecting liquid droplets from a head in which a plurality of ink chambers are aligned in an X direction or an XY direction, there is a problem that a nozzle of an ink chamber placed at an end portion in an alignment direction is clogged even if driving is effected to uniformly eject liquid droplets from the respective ink chambers. When ink clogging occurs in the nozzle of the ink chamber at the end portion, there is a phenomenon that ink clogging eventually likewise occurs in a nozzle of an inner ink chamber adjacent to this ink chamber and the nozzle clogging is propagated to the inner side. Since this phenomenon occurs even in case of a nonvolatile ink, it is a phenomenon different from nozzle clogging caused when a liquid is evaporated from a nozzle and dried.

As a result of keen examination conducted by the present inventors, a reason can be roughly considered as follows.

As shown in FIG. 1, in a head 1, an ink that is consumed by ejecting liquid droplets is supplied to respective ink chambers 11 aligned along the X direction in the drawing from a common ink chamber 13 communicating with the respective ink chambers 11. Although the ink in the common ink chamber 13 flows by the supply of the ink, flowability of the ink becomes poor around ink chambers 11*b*, 11*b* placed at end portions in the alignment direction as compared with the periphery of ink chambers 11*a* placed in a central portion in the alignment direction. That is because the ink around the ink chambers 11*a* in the central portion has high flowability when it flows toward the ink chambers 11*a* and ink chambers 11 on both sides thereof since the ink chambers 11 are arranged on both sides of the ink chambers 11*a* in the central portion, whereas the ink around the ink chambers 11*b*, 11*b* at both the end portions has lower flowability than that around the ink chambers 11*a* in the central portion since ink chambers are arranged only on the inner sides of the ink chambers 11*b*, 11*b* at both the end portions.

Since solid particles contained in a ceramic ink or a white ink have the higher specific gravity than regular color pigment particles, the solid particles in the ink are apt to settle out in a region having the low ink flowability as compared with a region having the high ink flowability. When the ink containing the solid particles that are apt to settle out is supplied to the ink chambers 11*b*, 11*b* at both the end portions, the solid particles settle out faster than in the ink chambers 11*a* in the central portion. As a result, when each nozzle 12 is arranged to be vertically downward directed as shown in FIG. 15, the solid particles S settle out near the nozzle 12 in the ink chamber 11, density of the solid particles 20 increases, and the nozzle clogging occurs.

Further, as such an ink, there is an ink that is used while being heated from an ordinary temperature to a predetermined temperature (e.g., 35° C. to 50° C.) by, e.g., arranging a heater (not shown) in the common ink chamber 13. When the ink is heated, its viscosity is lowered, and the ink can be easily flowed. In this case, since the ink chambers 11*a* in the central portion have the ink chambers 11 on both sides thereof, the vicinity of the ink chambers 11*a* is filled with the heated ink, an ink temperature is stable, but the ink near the ink chambers 11*b*, 11*b* at both the end portions has a low temperature and is apt to have high viscosity since the ink chambers are not provided on the outer side of these ink chambers. As a result, the flowability of the ink is lowered near the ink chambers 11*b*, 11*b* at both the end portions, and the solid particles in the ink are apt to settle out.

Furthermore, when the nozzles 12 of the ink chambers 11*b*, 11*b* at both the end portions are clogged, the ink is no longer supplied to these ink chambers 11*b*, 11*b* at both the ends, then the flowability of the ink around the ink chambers 11 adjacent to these ink chambers on the inner side is thereby lowered, and the ink clogging eventually occurs. It can be considered that the nozzle clogging is consequently gradually propagated toward the inner side.

Moreover, even when each nozzle 12 is arranged sideways, there is a problem that the solid particles in liquid droplets ejected from the nozzle 12 cannot have adequate concentration due to sedimentation of the solid particles and turbulence in ejection speed or non-uniformity of images is caused.

In the prior art, to reduce the sedimentation of solid substances such as a pigment in the ink, a technology that uses a pressure difference between a head and an ink tank to circulate an ink has been suggested (Patent Document 1). However, the ink on the head side that is circulated by this technology is an ink dedicated to a common chamber, and the ink that has been supplied to each ink chamber cannot be circulated. Therefore, the sedimentation of solid particles that occurs in the ink chambers cannot be suppressed at the time of printing pause.

As a countermeasure for the nozzle clogging at the time of printing pause, there is known a technology for applying a spare waveform to each ink chamber to vibrate a meniscus immediately before restarting ejection, thereby allowing an ink in the ink chambers to flow (Patent Document 2). However, this technology eliminates the nozzle clogging due to an increase in viscosity caused by evaporation of a volatile component in the ink. Since flow of the ink caused by such meniscus vibration is very small, this flow is effective for elimination of the nozzle clogging caused by the evaporation, but just slightly vibrating the meniscus cannot sufficiently eliminate a sedimentation state of the solid particles that has advanced in the ink chambers to some extent.

Moreover, there is also known that nozzle recovery is performed by performing a so-called flushing operation for forcedly discharging liquid droplets from the nozzle (Patent Document 3). However, this normalizes an increase in concentration of an ink due to evaporation of the ink by using preliminary ejection of the ink, and it does not avoid the nozzle clogging in an ink chamber at an end portion caused by sedimentation of solid particles having the specific gravity higher than that of a dispersion medium contained in the ink.

PRIOR ART DOCUMENTS

Patent Documents

Patent Document 1: JP-A-2011-506152
Patent Document 2: JP-A-2000-203020
Patent Document 3: JP-A-4-128049

Since the flushing operation of continuously forcedly ejecting liquid droplets enables discharging an ink containing solid particles that have settled out, it is considered to be effective for avoiding nozzle clogging due to sedimentation of the solid particles in each ink chamber. However, since the sedimentation of the solid particles is prominent in the ink chamber at the end portion as described above, uniformly ejecting liquid droplets from all the ink chambers wastefully consumes the ink.

Additionally, it is known that, when the ink containing the solid particles is ejected, a satellite is apt to be produced. There is a problem that, when a satellite is produced at the time of ejection, the periphery is contaminated with the ink scattered by the satellite. Therefore, it is desirable to set liquid droplets ejected by the flushing operation to the necessary minimum.

SUMMARY OF THE INVENTION

The present invention has been made in view of the aforementioned problems. The object of the present invention is to provide a liquid droplet ejection apparatus that can efficiently suppress sedimentation of solid particles contained in an ink with a small ejection amount of the liquid droplets and stably eject the liquid droplets for a long time.

Further, it is another object of the present invention to provide a method for recovering a nozzle of a liquid droplet ejection apparatus that can efficiently suppress sedimentation of solid particles contained in an ink with a small ejection amount of the liquid droplets and stably eject the liquid droplets for a long time.

To achieve the abovementioned objects, a liquid droplet ejection apparatus reflecting one aspect of the present invention are:

a liquid droplet ejection apparatus comprising a head in which a plurality of ink chambers to which an ink is supplied are aligned in one or both of an X direction and a Y direction, liquid droplets are ejected from nozzles provided in accordance with the ink chambers, and printing is carried out in a print region of a recording medium based on print data, wherein the ink contains a dispersion medium and solid particles having higher specific gravity than that of the dispersion medium, and the liquid droplet ejection apparatus comprises a flushing device that performs a flushing operation for continuously ejecting liquid droplets from the nozzles when the head is present in a non-print region where the printing is not performed in such a manner that an amount of liquid droplets ejected from the nozzle placed at an end portion in an alignment direction becomes larger than an amount of liquid droplets ejected from the nozzle placed in a central portion in the alignment direction.

Preferably, as specific gravity of the solid particles relative to the dispersion medium in the ink used in the head rises, the flushing device increases any one or both of an amount of liquid droplets ejected from the nozzles by the flushing operation and a frequency of performing the flushing operation beyond that when the specific gravity is small.

Preferably, the head is formed of a plurality of heads having different types of the inks, and the flushing device increases any one or both of an amount of liquid droplets ejected from the nozzles by the flushing operation and a frequency of performing the flushing operation in the head that uses an ink having the higher specific gravity of the solid particles relative to the dispersion medium beyond the head that uses an ink having the lower specific gravity in the plurality of heads.

Preferably, the liquid droplet ejection apparatus has a liquid droplet speed detection device that detects a speed of the liquid droplets ejected from the nozzles, wherein the flushing device starts the flushing operation after detecting that a detection result of the liquid droplet speed detection device falls below a preset threshold value.

Preferably, the liquid droplet ejection apparatus has a liquid droplet speed detection device that detects a speed of the liquid droplets ejected from the nozzles, wherein the flushing device adjusts an amount of liquid droplets ejected from the nozzles by the flushing operation in accordance with a detection result of the liquid droplet speed detection device.

Preferably, the flushing device increases the amount of liquid droplets ejected from the nozzle placed at the end portion in the alignment direction based on the flushing operation by one or both of increasing the number of liquid droplets ejected from the nozzles and increasing a volume of each of the liquid droplets ejected from the nozzles.

Preferably, the liquid droplet ejection apparatus has an ink tank that stores the ink that is supplied to the head; and a circulation device that circulates the ink between the head and the ink tank, wherein the circulation device circulates the ink during a period that at least the flushing operation is performed.

Preferably, a specific gravity difference between the dispersion medium and the solid particles in the ink is 0.2 or more.

Preferably, the ink does not volatilize from the nozzles by drying.

To achieve the abovementioned objects, a method for recovering a nozzle of a liquid droplet ejection apparatus reflecting one aspect of the present invention are:

a method for recovering a nozzle of a liquid droplet ejection apparatus comprising a head in which a plurality of ink chambers to which an ink is supplied are aligned in one or both of an X direction and a Y direction, liquid droplets are ejected from nozzles provided in accordance with the ink chambers, and printing is carried out in a print region of a recording medium based on print data, wherein the ink contains a dispersion medium and solid particles having higher specific gravity than that of the dispersion medium, and the method comprises a flushing process of performing a flushing operation for continuously ejecting liquid droplets from the nozzles when the head is present in a non-print region where the printing is not performed in such a manner that an amount of liquid droplets ejected from the nozzle placed at an end portion in an alignment direction becomes larger than an amount of liquid droplets ejected from the nozzle placed in a central portion in the alignment direction.

Preferably, the in the flushing process, as specific gravity of the solid particles relative to the dispersion medium in the ink used in the head rises, any one or both of an amount of liquid droplets ejected from the nozzles by the flushing operation and a frequency of performing the flushing operation are increased.

Preferably, the head is formed of a plurality of heads having different types of the inks, and the flushing process is configured to increase any one or both of an amount of liquid droplets ejected from the nozzles by the flushing operation and a frequency of performing the flushing operation in the head that uses an ink having the higher specific gravity of the solid particles relative to the dispersion medium beyond the head that uses an ink having the lower specific gravity in the plurality of heads.

Preferably, the method for recovering a nozzle of a liquid droplet ejection apparatus has a liquid droplet speed detection process configured to detect a speed of the liquid droplets ejected from the nozzles, wherein, in the flushing process, the flushing operation is started after detecting that a detection result of the liquid droplet speed detection device falls below a preset threshold value.

Preferably, the method for recovering a nozzle of a liquid droplet ejection apparatus has a liquid droplet speed detection process configured to detect a speed of the liquid droplets ejected from the nozzles, wherein, in the flushing process, an amount of liquid droplets ejected from the nozzles by the flushing operation is adjusted in accordance with a detection result of the liquid droplet speed detection process.

Preferably, the in the flushing process, the amount of liquid droplets ejected from the nozzle placed at the end portion in the alignment direction based on the flushing operation is increased by one or both of increasing the number of liquid droplets ejected from the nozzles and increasing a volume of each of the liquid droplets ejected from the nozzles.

Preferably, the ink is circulated between the ink tank and the head during a period that at least the flushing operation is performed.

Preferably, a specific gravity difference between the dispersion medium and the solid particles in the ink is 0.2 or more.

Preferably, the ink does not volatilize from the nozzles by drying.

BRIEF DESCRIPTION OF DRAWINGS

FIG. 10 is a view for explaining an example of detecting means for detecting a sedimentation state of solid particles;

FIG. 11 is a table in which a relationship between a degree of deviation of a liquid droplet speed from a set speed and pulse numbers applied to the ink chambers at the end portion and the central portion is defined;

FIG. 12 is a view for explaining an example of a configuration for circulating an ink;

DESCRIPTION OF THE PREFERRED EMBODIMENTS

An embodiment according to the present invention will now be described hereinafter in detail.

Figure 1:
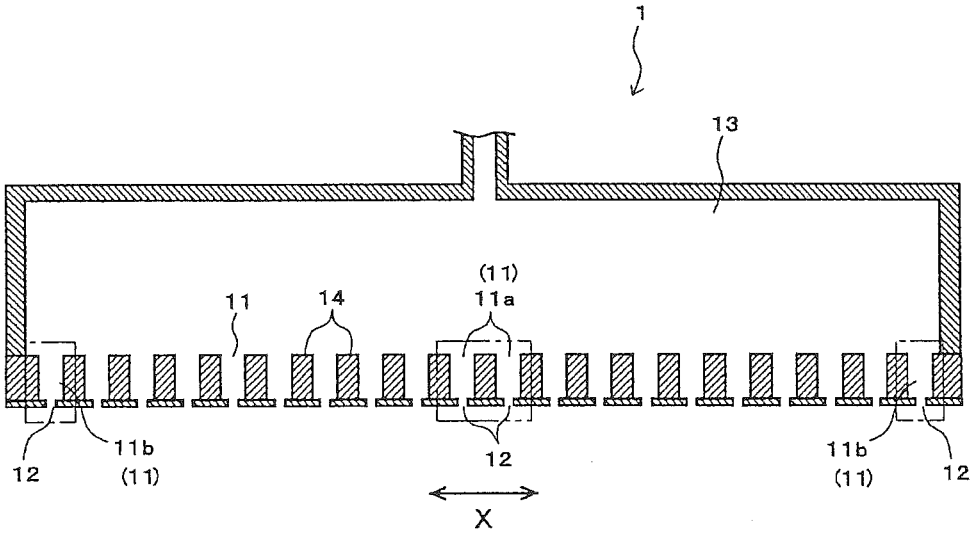
FIG. 1 is a cross-sectional view of a head in a liquid droplet ejection apparatus.
Figure 2:
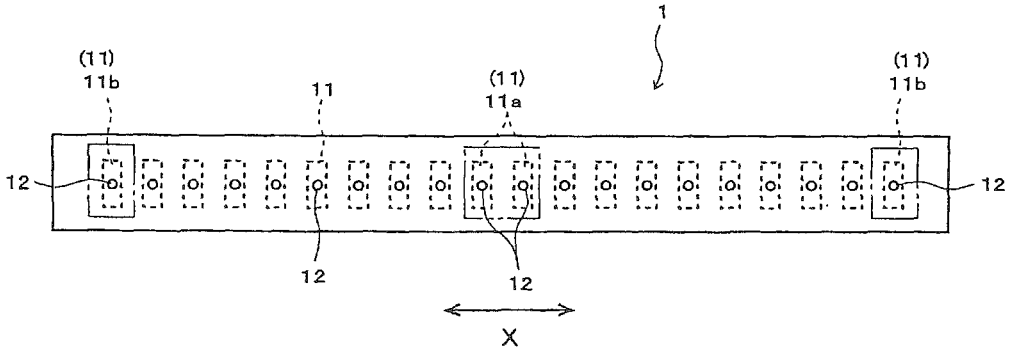
FIG. 2 is a view showing the head depicted in FIG. 1 from a nozzle surface side.

FIG. 1 is a cross-sectional view of a head in a liquid droplet ejection apparatus, and FIG. 2 is a view showing the head depicted in FIG. 1 from a nozzle surface side.

In the head 1, a plurality of ink chambers 11 are aligned along an X direction in the drawing. Here, an example where the 20 ink chambers 11 are aligned in line along the X direction is shown, but the number of the ink chambers 11 is out of the question. In this head 1, all the ink chambers 11 are ink chambers from which liquid droplets can be ejected from nozzles 12 that are provided in accordance with the respective ink chambers 11 when an ink in a common ink chamber 13 is supplied thereto. A heater (not shown) configured to heat the ink inside from an ordinary temperature to a predetermined temperature (e.g., 35° C. to 50° C.) at the time of use may be provided to the common ink chamber 13.

In this head 1, each partition wall 14 that separates the neighboring ink chambers 11, 11 from each other is formed of a piezoelectric element as ejection energy giving means. A drive electrode (not shown) is formed on a surface of each partition wall 14 facing the inside of the ink chamber 11, and each partition wall 14 is deformed and a capacity in the ink chamber 11 is changed when an ejection pulse of a predetermined voltage is applied to each drive electrode from a later-described head driver. As a result, the ejection energy is given to the ink in each ink chamber 11, and liquid droplets are ejected from the nozzle 12.

Here, the ink used in the present invention contains solid particles having higher specific gravity than that of a dispersion medium besides the dispersion medium. The dispersion medium is out of the question. As the solid particles, there are pigment particles of a titanium oxide, ceramic particles, and others. When a difference in specific gravity of the solid particles from the dispersion medium increases, a sedimentation speed of the solid particles rises, the solid particles are apt to settle out in the ink chambers, and a problem of the present invention becomes prominent. It is preferable for the difference in specific gravity between the dispersion medium and the solid particles to be 0.2 or more since an effect of the present invention can be prominently provided.

In the present invention, an ink that does not volatilize at an ordinary temperature under an ordinary pressure is used. Here, "not volatilize" means an ink in which the content of a material, whose steam pressure at an ordinary temperature is higher than that of water, is 10% or less or preferably 5% or less. Such an ink does not have a problem of an increase in viscosity due to evaporation of a volatile component that can be observed when a volatile ink such as an aqueous ink is used at the time of use. As such an ink, for example, there are a UV ink, an oil ink, and others.

Figure 3:
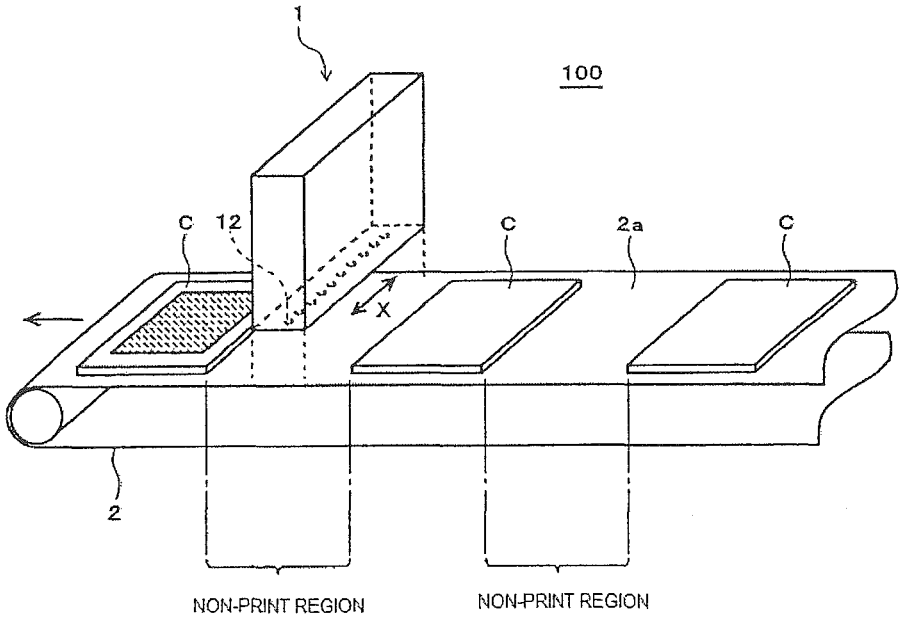
FIG. 3 is a perspective view showing an example of a line type liquid droplet ejection apparatus.

FIG. 3 shows an example of a liquid droplet ejection apparatus using such a head 1.

Here, there is shown a liquid droplet apparatus 100 in which ceramic tiles C as recording mediums are mounted at intervals on a conveyance surface 2*a* of a conveyance belt 2 that is driven to rotate in one direction and they are conveyed. The head 1 is arranged to be vertically downward directed to face the conveyance surface 2*a* in such a manner that an alignment direction X of the nozzles 12 is parallel to a width direction of the conveyance belt 2. Further, a ceramic ink containing ceramic particles having specific gravity higher than that of dispersion medium is ejected as solid particles from the respective nozzles 12 to a print region on a front surface of each ceramic tile C that is conveyed at a fixed speed by the conveyance belt 2 based on print data, thereby forming a predetermined image.

Figure 4:
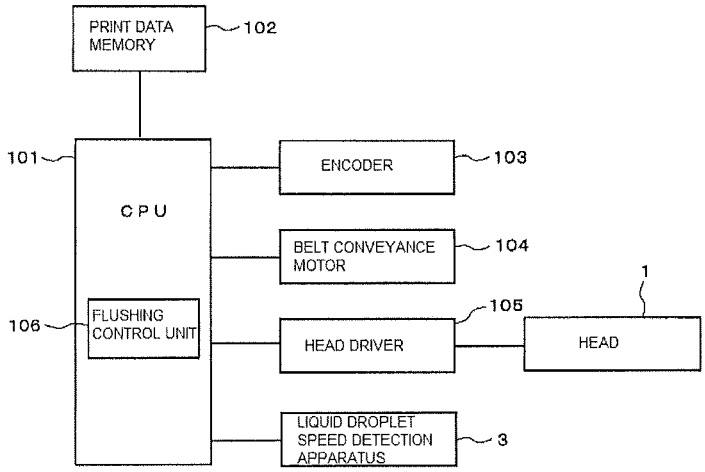
FIG. 4 is a block diagram showing an outline configuration of the liquid droplet ejection apparatus.

FIG. 4 is a block diagram showing an outline configuration of the inside of the liquid droplet ejection apparatus 100.

Reference numeral 101 denotes a CPU that controls the entire liquid droplet ejection apparatus 100; 102, a print data memory that stores print data to be formed in a print region on the surface of each ceramic tile C; 103, an encoder that detects a moving length of the conveyance belt 2; 104, a belt conveyance motor that drives the conveyance belt 2 to rotate; 105, a head driver that gives an ejection pulse to the drive electrodes of the head 1 to deform the partition walls 14; and 106, a flushing control unit that controls a flushing operation of the head 1 and a flushing device for the present invention.

In FIG. 3, printing based on print data is not performed between the ceramic tiles C, C continuously mounted on the conveyance surface 2*a*. In case of ejecting the ink containing solid particles having higher specific gravity than that of the dispersion medium from the nozzles 12 in accordance with print data, an ejection failure such as nozzle clogging may possibly occur due to sedimentation of the solid particles when a small printing pause period has been undergone in this manner. Thus, in the present invention, when the head 1 is present in this non-print region, the flushing operation of ejecting a predetermined amount of liquid droplets from each nozzle 12 is executed based on control of the flushing control unit 106, and the ink containing the solid particles that have settled out in each ink chamber 11 is forcedly discharged to recover the nozzle 12, thereby stabilizing the ejection.

It is to be noted that, in the present invention, as different from the print region where liquid droplets are ejected from the nozzles 12 based on print data and printing is carried out on a recording medium, the non-print region means a region that is out of the recording medium and also a region where no print data is provided and printing based on the print data is not performed. As seen from the head 1, print regions and non-print regions alternately fed. In this liquid droplet ejection apparatus 100, a space between the ceramic tiles C, C continuously mounted on the conveyance surface 2*a* at an interval is the non-print region where printing based on print data is not carried out. Arrival of the head 1 at the non-print region is detected based on a moving length of the conveyance belt 2 detected by the encoder 103.

At the time of the flushing operation, in the ink chambers 11, as shown in FIG. 1 and FIG. 2, an amount of liquid droplets ejected from the nozzles 12 of the respective ink chambers 11*b*, 11*b* placed at the end portions in the alignment direction along the X direction is different from an amount of liquid droplets ejected from the nozzles 12 of the ink chambers 12*a* placed in the central portion in the same alignment direction. That is, the flushing operation is performed in such a manner that the amount of liquid droplets ejected from the nozzles 12 of the ink chambers 11*b*, 11*b* placed at the end portions is larger than the amount of liquid droplets ejected from the nozzles 12 of the ink chambers 11*a* placed in the central portion.

As a result, the flowability of the ink around the ink chambers 11*b*, 11*b* at the end portions where the fluidity tends to lower as compared with the ink around the ink chambers 11*a* in the central portion is improved, and inflow or replacement of a new ink that flows in to the ink chambers 11*b*, 11*b* is hastened. Therefore, sedimentation of the solid particles in the ink can be suppressed or eliminated, the nozzle clogging can be avoided, and hence stable ejection is enabled for a long time. Since the nozzle clogging in the ink chambers 11*b*, 11*b* at the end portions can be avoided, it is also possible to prevent a phenomenon that the nozzle clogging is sequentially propagated to the inner ink chambers 11.

Further, since an amount of liquid droplets to be ejected is relatively small in the ink chambers 11*a* in the central portion, and hence excessive liquid droplets cannot be ejected from the ink chambers 11*a* in the central portion. Therefore, the ink consumed by the flushing operation can be required minimum, and the sedimentation of the solid particles in the ink chambers 11 can be efficiently suppressed with a small amount of liquid droplets.

Here, the ink chambers placed at the end portions in the alignment direction means ink chambers placed at the outermost end portions in the alignment direction in the ink chambers 11 configured to eject liquid droplets from the nozzles 12 when the ink is supplied thereto from the common ink chambers 13. Although a dummy ink chamber (not shown) from which liquid droplets are not ejected without supply of the ink may be arranged outside the ink chambers at the end portions, such a dummy ink chamber from which the liquid droplets are not ejected is not included. Further, the ink chamber placed in the central portion in the alignment direction also means the ink chamber placed in the central portion in the alignment direction of the ink chambers 11 configured to eject liquid droplets from the nozzles 12 upon receiving the ink from the common ink chamber 13, and the dummy ink chamber from which the liquid droplets are not ejected without receiving the ink is not included.

It is to be noted that the two ink chambers 11*a* placed in the central portion are present since the number of the ink chambers 11 is an even number in this embodiment, but the one ink chamber 11*a* is placed in the central portion when the number of the ink chambers 11 is an odd number.

An ejection pulse that is provided to the head 1 to eject liquid droplets from each nozzle 12 at the time of the flushing operation is previously stored in the head driver 105, and it is applied to the drive electrode on each partition wall 14 of the head 1 based on an instruction from the CPU 101. Here, in a case where an ejection pulse P1 that is used at the time of regular printing shown in FIG. 5(*a*) is adopted as the ejection pulse at the time of the flushing operation, a total number of applications (a total application time) of the ejection pulse P1 to the ink chambers 11*b*, 11*b* at the end portions per flushing operation is increased. As a result, the number of liquid droplets ejected from the nozzles 12 of the ink chambers 11*b*, 11*b* at the end portions in the flushing operation can be increased beyond the number of liquid droplets ejected from the nozzles 12 of the ink chambers 11*a* in the central portion. Since one type of pulse used at the time of printing can suffice as the ejection pulse P1, a configuration of the head driver 105 can be simplified.

Figure 6:
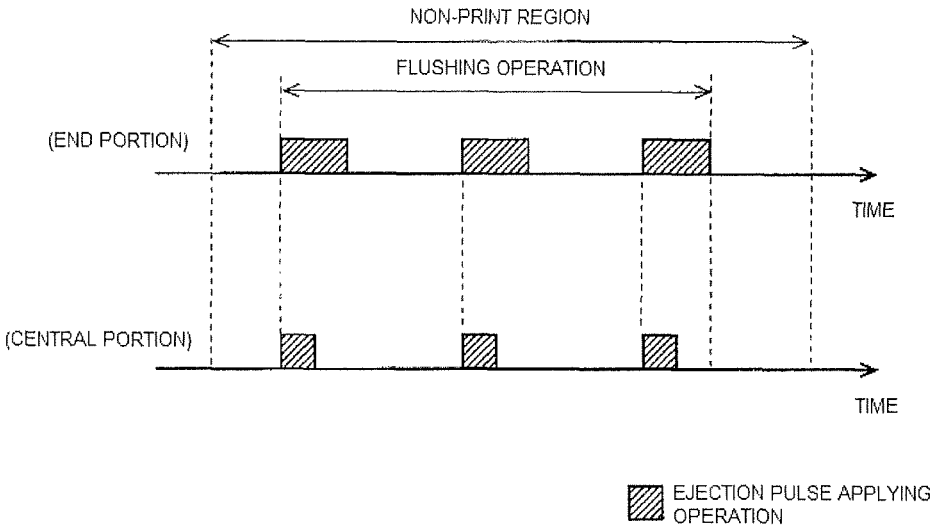
FIG. 6 is a view showing an example of ejection pulse application timing of each of an ink chamber at an end portion and an ink chamber in a central portion at the time of a flushing operation.

In FIG. 6, one flushing operation is constituted by performing one set of pulse applying operations for continuously applying the ejection pulse P1 (a region indicated by oblique lines) in one non-print region. In this example, one flushing operation is carried out by three pulse applying operations on each of the end portions and the central portion. In this case, since the total number of applications of the ejection pulse P1 applied to the ink chambers 11*b*, 11*b* at the end portions is larger, the total number of liquid droplets in one flushing operation is higher at the end portions than in the central portion. Therefore, an amount of liquid droplets ejected from the nozzles 12 of the ink chambers 11*b*, 11*b* at the end portions in the flushing operation is higher than an amount of liquid droplets ejected from the nozzles 12 of the ink chambers 11*a* in the central portion.

Figure 7:
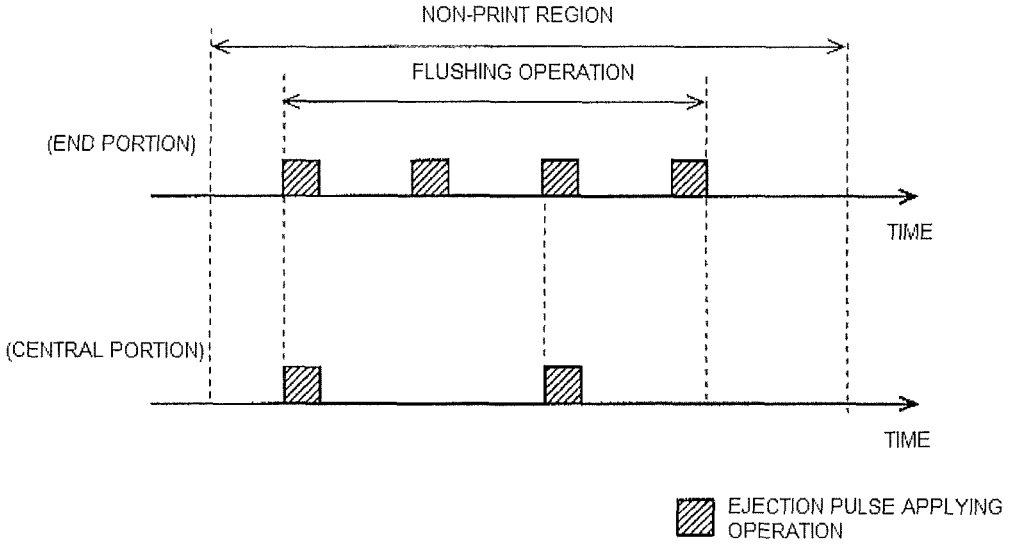
FIG. 7 is a view showing another example of ejection pulse application timing of each of the ink chamber at the end portion and the ink chamber in the central portion at the time of the flushing operation.

The number of times of performing one set of pulse applying operations in a single flushing operation is out of the question. In FIG. 6, the pulse applying operation is performed in three steps in the single flushing operation, and the number of applications of the ejection pulse P1 to the ink chambers 11*b*, 11*b* at the end portions is higher than the number of applications to the ink chambers 11*a* in the central portion in each pulse applying operation, but the number of applications (an application time) of the ejection pulse P1 per pulse application time at the end portion may be the same as the counterpart in the central portion as shown in FIG. 7 so that the number of times of the pulse applying operations in one flushing operation at the end portions can be higher than that in the central portion. FIG. 7 shows an example that the pulse applying operations in one flushing operation is set to four at the end portions and two at the central portion.

Further, both the number of applications of the ejection pulse P1 in the pulse applying operation and the number of times of the pulse applying operations in one flushing operation may be higher at the end portions than in the central portion.

Additionally, as the ejection pulse that is provided to the head 1 to eject liquid droplets from the nozzle 12 of each ink chamber 11 at the time of the flushing operation, it is possible to use an ejection pulse that differs depending on the ink chambers 11*b*, 11*b* at the end portions and the ink chambers 11*a* in the central portion.

Figure 5:
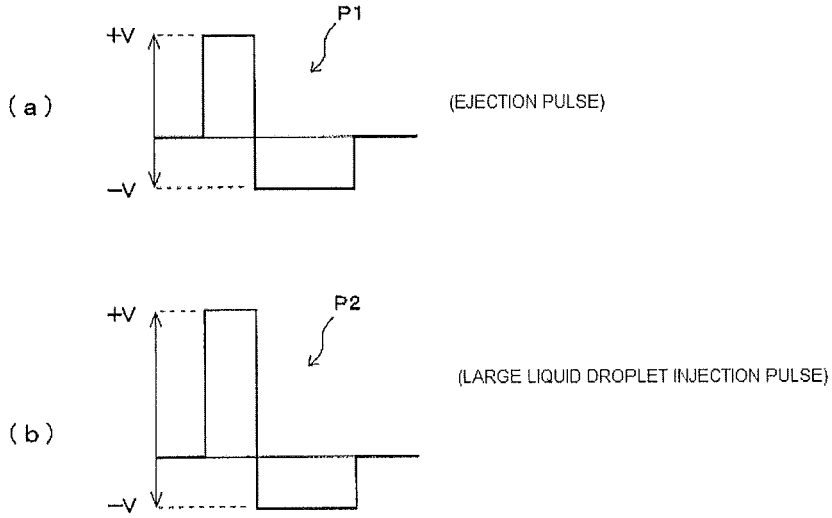
FIG. 5(*a*) is a view showing an example of an ejection pulse, and FIG. 5(*b*) is a view showing an example of a large liquid droplet ejection pulse.

FIG. 5(*b*) shows an example of the ejection pulse applied to the ink chambers 11*b*, 11*b* at the end portions at the time of the flushing operation. This ejection pulse P2 has a voltage value +V set larger than that of the ejection pulse P1 in regular printing shown in FIG. 5(*a*), and it is a large liquid droplet ejection pulse that enables ejecting a liquid droplet having a larger volume from the nozzle 12 than the ejection pulse P1. This large liquid droplet ejection pulse P2 is stored in the head driver 105 together with the ejection pulse P1, and it is applied to the ink chambers 11*b*, 11*b* at the end portions of the head 1 in response to an instruction from the flushing control unit 106 of the CPU 101.

Figure 8:
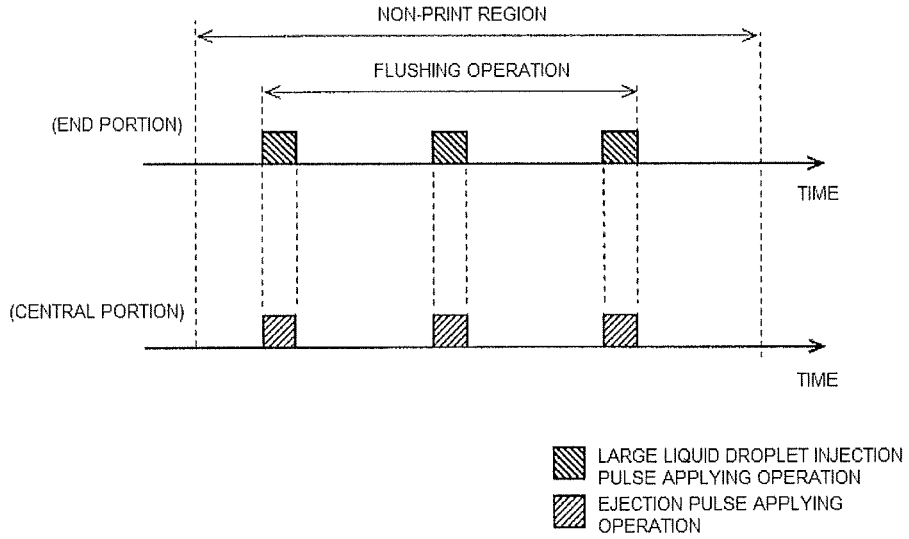
FIG. 8 is a view showing still another example of ejection pulse application timing of each of the ink chamber at the end portion and the ink chamber in the central portion at the time of the flushing operation.

FIG. 8 shows an example where the large liquid droplet ejection pulse P2 is applied to the ink chambers 11*b*, 11*b* at the end portions and the regular ejection pulse P1 is applied to the ink chambers 11*a* in the central portion in one non-print region. In this case, one set of pulse applying operations is performed in three steps at each of the end portions and the central portion in one flushing operation, and the number of pulse applications in each pulse applying operation at the end portions is the same as that in the central portion. However, since each ejection pulse applied to the ink chambers 11*b*, 11*b* at the end portions is the large liquid droplet ejection pulse P2, a volume per liquid droplet to be ejected is larger than that of the ejection pulse P1 that is applied to the ink chambers 11*a* in the central portion. Therefore, a total amount of liquid droplets ejected from the nozzles 12 of the ink chambers 11*b*, 11*b* at the end portions in one flushing operation is larger than a total amount of liquid droplets ejected from the nozzles 12 of the ink chambers 11*a* in the central portion.

As described above, when the large liquid droplet ejection pulse P2 is applied to the ink chambers 11*b*, 11*b* at the end portions in the flushing operation, even though the number of pulse applications in each pulse application operation at the end portions is the same as that in the central portion, an amount of liquid droplets ejected from the nozzles 12 of the ink chambers 11*b*, 11*b* at the end portions can be set higher than an amount of liquid droplets ejected from the nozzles 12 in the ink chambers 11*a* in the central portion. Therefore, even in case of performing the flushing operation in a limited period, the amount of liquid droplets ejected from the nozzles 12 of the ink chambers 11*b*, 11*b* at the end portions can be easily increased beyond that of the ink chambers 11*a* in the central portion.

In case of applying the large liquid droplet ejection pulse P2 to the ink chambers 11*b*, 11*b* at the end portions, the number of pulse applications in each pulse applying operation can be set higher at the end portions than in the central portion like FIG. 6. As a result, the amount of liquid droplets ejected from the nozzles 12 of the ink chambers 11*b*, 11*b* at the end portions can be increased.

Furthermore, even if the number of pulse applications in each pulse applying operation at the end portions is the same as that in the central portion, the number of times of the pulse applying operations in one flushing operation at the end portions can be set higher than that in the central portion like FIG. 7. As a result, the amount of liquid droplets ejected from the nozzles 12 of the ink chambers 11*b*, 11*b* at the end portions can be likewise increased.

Moreover, the number of applications of the large liquid droplet ejection pulse P2 to the ink chambers 11*b*, 11*b* at the end portions in each pulse applying operation may be set higher than the number of applications of the ejection pulse P1 to the ink chambers 11*a* in the central portion, and the number of times of the pulse applying operations in one flushing operation at the end portions may be set higher than in the central portion. As a result, the amount of liquid droplets ejected from the nozzles 12 of the ink chambers 11*b*, 11*b* at the end portions can be further increased.

It is to be noted that the amount of liquid droplets ejected from the nozzles 12 of the ink chambers 11 other than those at the end portions and the central portion at the time of the flushing operation can be set as follows, for example.

Figure 9:
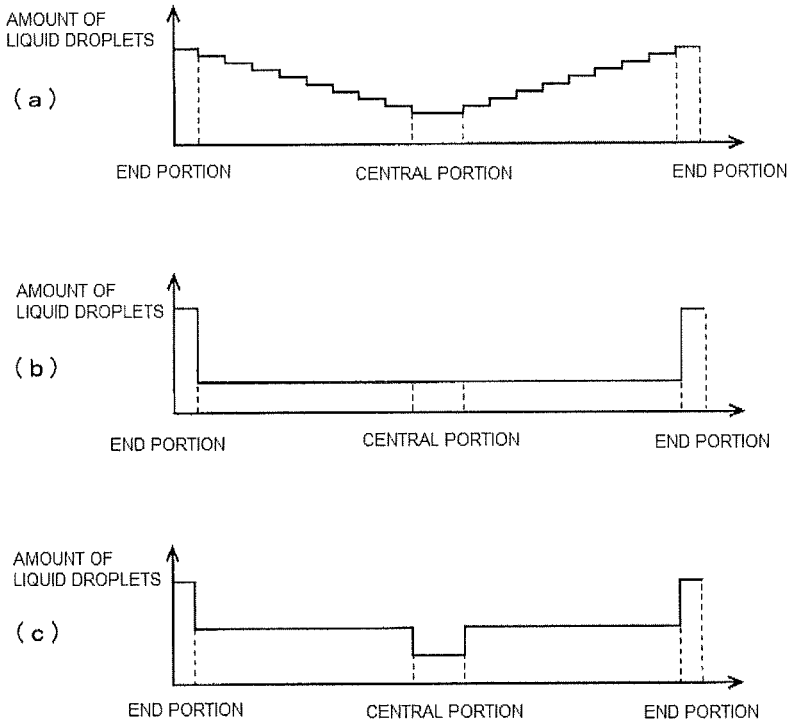
FIGS. 9(*a*) to (*c*) are views showing amounts of liquid droplets of ink chambers other than those of the end portion and the central portion.

FIG. 9(*a*) shows a conformation that the amount of liquid droplets ejected from the nozzles 12 of the ink chambers 11 other than those at the end portions and the central portion at the time of the flushing operation is set in such a manner that the amount of liquid droplets is gradually reduced from the end portions toward the central portion. According to this conformation, since the precise amount of liquid droplets according to a degree of flowability of the ink in the common ink chamber 13 from the ink chambers 11*b*, 11*b* at the end portions to the ink chambers 11*a* in the central portion along the alignment direction can be set, a concentration distribution in the ink chambers 11 can be more efficiently suppressed.

FIG. 9(*b*) shows a conformation that the amount of liquid droplets ejected from the nozzles 12 in the ink chambers 11 other that those at the end portions and the central portion at the time of the flushing operation is set to be equal to the amount of liquid droplets ejected from the nozzles 12 in the ink chambers 11*a* in the central portion. According to this conformation, an amount of the ink consumed by the flushing operation can be kept to the minimum.

FIG. 9(*c*) shows a conformation that the amount of liquid droplets ejected from the nozzles 12 of the ink chambers 11 other than those at the end portions and the central portion is set to be an amount of liquid droplets between the amount of liquid droplets at the end portions and the amount of liquid droplets at the central portion. According to this conformation, efficient suppression of a concentration distribution in the ink and suppression of consumption of the ink can be balanced.

Although the flushing operation can be performed every time the head 1 reaches a non-print region, there are cases where sedimentation of the solid particles in the ink in the ink chambers 11*b*, 11*b* at the end portions does not advance well like a situation where the amount of liquid droplets ejected from the nozzles 12 of the ink chambers 11*b*, 11*b* at the end portions is higher than that of the ink chambers 11*a* in the central portion. In such a case, when the flushing operation is performed every time the head 1 reaches a non-print region as described above, the ink may be wastefully consumed. Further, to suppress contamination of the periphery caused due to a satellite, it is desirable to keep the amount of liquid droplets ejected by the flushing operation to the necessary minimum.

Therefore, it is also preferable for the flushing control unit 106 to select whether the flushing operation is to be performed in accordance with a sedimentation state of the solid particles in the ink in the ink chambers 11, i.e., the progress of the sedimentation. As a result, the wasteful flushing operation can be prevented, and unnecessary consumption of the ink can be suppressed.

In general, an ejection speed of the liquid droplets ejected from the nozzle is lowered as an amount of the solid particles contained in the liquid droplets is increased. Therefore, it is possible to estimate how the sedimentation of the solid particles in the ink near the nozzles 12 in the ink chambers 11 is advanced from the ejection speed of the liquid droplets.

FIG. 10 shows a liquid droplet speed detection apparatus 3 which is an example of detecting means for detecting the ejection speed of the liquid droplets. This liquid droplet speed detection apparatus 3 is configured to operate in response to an instruction from the CPU 101 and transmit a result to the CPU 101 as shown in FIG. 4.

The liquid droplet speed detection apparatus 3 has a light projection unit 31 that emits detection light L like an LED or a laser and a light reception unit 32 formed of a photosensor or the like that receives this detection light L, and it is arranged near a position immediately below the nozzles 12 in such a manner that an optical axis of the detection light L becomes parallel to an X direction as the alignment direction of the nozzles 12 and parallel to a nozzle surface. As a result, a liquid droplet is ejected from each nozzle 12 crosses the detection light L, and shade formed when the liquid droplet a passes can be captured by the light reception unit 32. Furthermore, for example, when the ejection pulse P1 is applied to any ink chamber 11 and the liquid droplet a is ejected from the nozzle 12, the liquid droplet speed detection apparatus 3 calculates an ejection speed of the liquid droplet a from a time required for the light reception unit 32 to capture the shade of the liquid droplet a from application of the ejection pulse P1 and a distance from the nozzle 12 to the optical axis of the detection light L.

A threshold value indicative of a lower limit of a preferred ejection speed of the liquid droplet a is preset in one of the CPU 101, the flushing control unit 106, and the liquid droplet speed detection apparatus 3. If an ejection speed of the liquid droplet a detected when the head 1 is present in a non-print region or preferably an ejection speed of the liquid droplet a ejected from the nozzles 12 of the ink chambers 11*b*, 11*b* at the end portion is lower than this threshold value, the sedimentation of the solid particles in the ink in these ink chambers 11 advances, and it is possible to determine whether the flushing operation should be executed.

As a result, the flushing control unit 106 starts the flushing operation after detecting that the ejection speed of the liquid droplet a is lower than the threshold value and the sedimentation of the solid particles advances. On the other hand, when the ejection speed of the liquid droplet a is yet to be lower than the threshold value, it is determined that the sedimentation of the solid particles in the ink chambers 11 has not advanced so that flushing is required, and hence the flushing operation in the non-print region is not executed. Therefore, unnecessary consumption of the ink can be suppressed.

Additionally, in place of determining whether the flushing operation is to be executed in accordance with a detection result of the liquid droplet speed detection apparatus 3, it is possible to adjust an amount of liquid droplets ejected at the time of the flushing operation may be adjusted in accordance with the detected ejection speed of the liquid droplets, i.e., the progress of the sedimentation of the solid particles.

In this case, for example, a preferred ejection speed of the liquid droplet a is preset in one of the CPU 101, the flushing control unit 106, and the liquid droplet speed detection apparatus 3, the detected ejection speed of the liquid droplet a is compared with the set value, and a deviation of the detected ejection speed from the set value is obtained. Further, for example, as shown in FIG. 11, a table in which a relationship between a level of the deviation (%) and numbers of pulses in the pulse applying operation that are applied to the ink chambers 11*b*, 11*b* at the end portions and the ink chambers 11*a* in the central portion, respectively is defined is prepared in advance, the number of pulses is relatively reduced when the level of the deviation of the detected ejection speed from the set value is small, and the number of pulses is relatively increased when the level is large. As a result, the precise flushing operation according to the progress of the sedimentation of the solid particles in the ink in the ink chambers 11 can be performed. The further efficient suppression of the sedimentation of the solid particles and the suppression of unnecessary consumption of the ink can be achieved.

In such a table, the number of times of the pulse applying operations in one flushing operation may be defined in place of or in addition to the number of pulses in the pulse applying operation.

Moreover, a sedimentation speed of the solid particles generally differs depending on a level of the specific gravity of the solid particles relative to the dispersion medium contained in the ink, and the sedimentation is fast when the specific gravity is high. For example, even if the head is unchanged, the level of the specific gravity of the solid particles may differ when a type of an ink to be used is different. Additionally, in case of using the plurality of heads 1, types of solid particles contained in inks may be different depending on types (colors) of the inks in the respective heads, and the level of the specific gravity of the solid particles may differ depending on the respective heads using different colors.

Therefore, when an ink having high specific gravity of solid particles relative to a dispersion medium is used, it is preferable to increase an amount of liquid particles ejected from the nozzles 12 of the ink chambers 11 at the time of the flushing operation as compared with a case where an ink having small specific gravity is used. As a result, the effective sedimentation suppression according to the specific gravity of the solid particles in the ink can be achieved, and it is possible to suppress unnecessary consumption of the ink caused due to the excessive flushing operation in the head using the ink containing the solid particles with the small specific gravity.

A non-illustrated input switch or the like may be provided to the liquid droplet ejection apparatus 100 in advance, and the ink having the high specific gravity of the solid particles relative to the dispersion medium may be manually discriminated from the ink having the low specific gravity by an input operation of an operator in accordance with the type of the ink at the time of setting an ink tank containing the ink or an ink cartridge in the apparatus, or these inks may be automatically discriminated from each other by recognizing identifying information indicative of a type of the ink provided on the ink tank or the ink cartridge by using non-illustrated recognizing means provided in the liquid droplet ejection apparatus 100 when the ink tank or the ink cartridge is set in the apparatus. An input result or an identification result is transmitted to the flushing control unit 106, and the flushing control unit 106 controls the flushing operation based on the input result or the identifying result.

To differentiate the amount of liquid droplets ejected from the nozzles 12 at the time of the flushing operation depending on the level of the specific gravity of the solid particles relative to the dispersion medium in this manner, there are a conformation that the number of pulse applications in the pulse applying operation is increased when the specific gravity of the solid particles is high or the number of pulse applications is reduced when the specific gravity is low like the case shown in FIG. 6, a conformation that the number of times of the pulse applying operations in one flushing operation is increased when the specific gravity of the solid particles is high or the number of times of the pulse applying operations is reduced when the specific gravity is low like the case shown in FIG. 7, a conformation that both the number of pulse applications in the pulse applying operation and the number of times of the pulse applying operation are increased when the specific gravity of the solid particles is high or one of them is reduced when the specific gravity is low, and others. According to these conformations, the amount of liquid droplets ejected from the nozzles 12 by the flushing operation can be easily adjusted in accordance with the level of the specific gravity of the solid particles relative to the dispersion medium.

A frequency of performing the flushing operation may be adjusted based on the level of the specific gravity of the solid particles relative to the dispersion medium in the ink to be used. As an example of adjusting the frequency of performing the flushing operation, adjustment is carried out in such a manner that the flushing operation is performed in accordance with each non-print region when an ink having high specific gravity of the solid particles relative to the dispersion medium is used or one flushing operation is performed in accordance with every two non-print regions when an ink having low specific gravity is used.

Additionally, it is also possible to perform both adjustment of an amount of liquid droplets ejected from the nozzles 12 by the flushing operation based on the level of the specific gravity of the solid particles relative to the dispersion medium and adjustment of a frequency of performing the flushing operation.

These operations can be executed by previously preparing a table in which a relationship between a level of specific gravity of the solid particles relative to the dispersion medium, numbers or frequencies of pulses applied to the ink chambers 11*b*, 11*b* at the end portions and the ink chambers 11*a* in the central portion, and others is defined like the example shown in FIG. 1 and making reference to this table at the time of the flushing operation.

As shown in FIG. 12, the ink in the common ink chamber 13 of the head 1 can be circulated between the common ink chamber 13 and an ink tank 4 that stores the ink as shown in FIG. 12. A supply pipe 41 and a return pipe 42 are connected between the common ink chamber 13 of the head 1 and the ink tank 4, a circulation pump 43 is provided to the return pipe 42, and the supply pipe 41, the return pipe 42, and the circulation pump 43 constitute circulating means. Further, the ink is circulated between the ink tank 4 and the common ink chamber 13 of the head 1 by drive of the circulation pump 43. As a result, since the ink stored in the common ink chamber 13 can have uniform concentration, the ink having the uniform concentration can be supplied to the ink chambers 11, whereby sedimentation of the solid particles in the ink in the ink chambers 11 can be further suppressed.

Although it is desirable to constantly perform this ink circulating operation based on drive of the circulation pump 43 irrespective of a case where the head 1 is present in the print region and a case where it is present in the non-print region, in order to enable replacing the ink in each ink chamber 11 with an ink having uniform concentration at the time of the flushing operation, it is preferable to carry out the ink circulating operation at least during a period that the flushing operation is performed.

Although the description has been given as to the example that the head 1 of the liquid droplet ejection apparatus 100 has the ink chambers 11 (the nozzles 12) aligned in line along one X direction, the ink chambers 11 (the nozzles 12) may be aligned along two directions, i.e., the X direction and a Y direction crossing this X direction or may be aligned along the Y direction alone.

Figure 13:
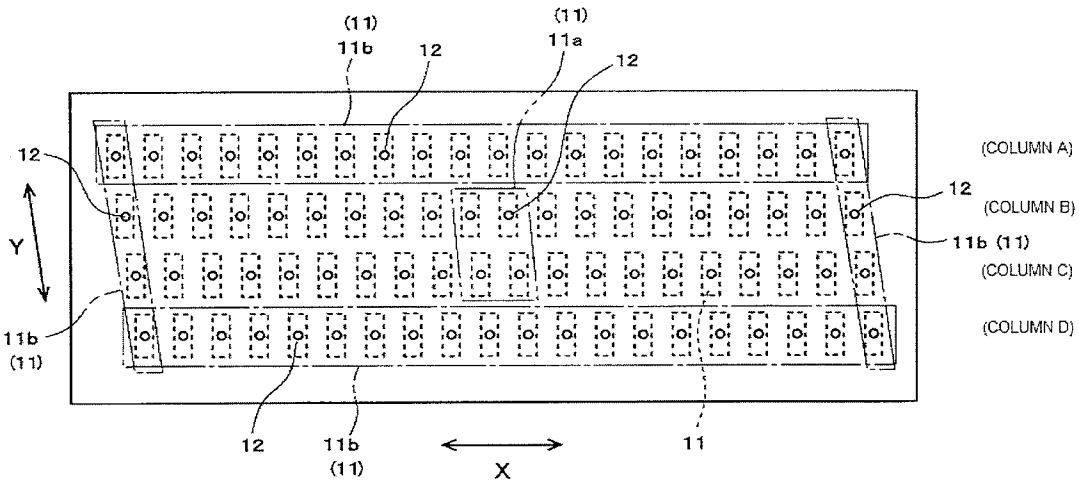
FIG. 13 is a view showing a head from a nozzle surface side according to another embodiment.

FIG. 13 shows an example of the head 1 in which the ink chambers 11 (the nozzles 12) are aligned along two directions, i.e., the X direction and the Y direction. Here, as shown in FIG. 1 and FIG. 2, four columns of the ink chambers 11, each column of which is formed of 20 ink chambers 11 aligned along the X direction, are arranged in the Y direction, and a column A, a column B, a column c, and a column D of the ink chambers 11 are formed from the upper side in the drawing. The ink is supplied from one common ink chamber (not shown) to all of these ink chambers 11.

The alignment directions of the ink chambers in this case are the two directions, i.e., the X direction and the Y direction. Therefore, the ink chambers placed at the end portions in the alignment directions are a total of eight chambers 11*b* placed at the end portions of the column A to the column D as seen in the direction X. Moreover, as seen in the Y direction, all the ink chambers in the column A and the column D are placed at the end portions in the Y direction, and all the ink chambers in the column A and the column Dare the ink chambers 11*b* placed at the end portions in the alignment directions.

That is, the ink chambers placed at the end portions in the alignment directions are all the ink chambers 11 corresponding to the nozzles 12 that are surrounded by a dashed dotted line and arranged at the periphery of the nozzle surface when the head 1 is seen from the nozzle surface. Since the number of the ink chambers 11 adjacent to the ink chambers 11*b* at the end portions is small as compared with the other ink chambers 11, flowability of the ink around the ink chambers 11*b* tends to be lower than that of the other ink chambers 11, and the solid particles in the ink in the ink chambers 11*b* are apt to settle out.

On the other hand, although the ink chambers placed in the central portion in the alignment directions are a total of eight ink chambers placed at the center in each of the column A to the column D as seen in the X direction, since the ink chambers in the column A and the column D in these eight ink chambers are placed at the end portions, respectively as seen in the Y direction, the ink chambers that are surrounded by a dashed-two dotted line and placed in the central portion of the column B and the column C are the ink chambers 11*a* placed in the central portion in the alignment directions.

As described above, even in the head 1 in which the ink chambers 11 are aligned in the X direction and the Y direction, when an amount of liquid droplets ejected from the nozzles 12 of the ink chambers 11*b* at the end portions is set to differ from that ejected from the nozzles 12 of the ink chambers 11*a* in the central portion at the time of the flushing operation, it is possible to efficiently achieve both suppression of sedimentation of the solid particles in the ink chambers 11*b* at the end portions and suppression of unnecessary consumption of the ink.

Further, as the above liquid droplet ejection apparatus 100, the line type liquid droplet ejection apparatus that performs printing on a surface of the ceramic tile C as a recording medium in one pass has been described. However, the liquid droplet ejection apparatus may perform printing on any kind of recording medium. Furthermore, the liquid droplet ejection apparatus may be a scan type liquid droplet ejection apparatus that performs printing by reciprocating the head 1 in a main scan direction.

Figure 14:
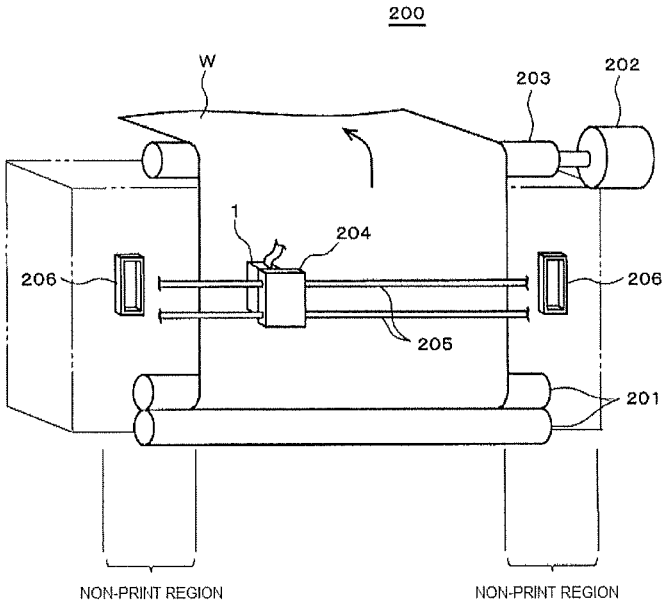
FIG. 14 is an outside drawing showing an example of a scan type liquid droplet ejection apparatus.
Figure 15:
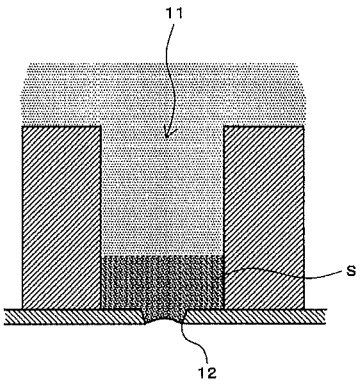
FIG. 15 is a view for explaining how solid particles settle out in the ink chamber.

FIG. 14 shows an example of such a scan type liquid droplet ejection apparatus.

In a liquid droplet ejection apparatus 200, a recording medium W is sandwiched between a pair of conveyance rollers 201 and conveyed in a direction indicated by an arrow (a sub-scan direction) by a conveyance roller 203 that is driven to rotate by a conveyance motor 202.

A head 1 is provided between the conveyance roller 203 and the pair of conveyance rollers 201 so as to face a surface of the recording medium W. The head 1 is arranged and mounted on a carriage 204 in such a manner that a nozzle surface side faces the recording medium W. The carriage 204 is provided to enable its reciprocating motion along a left-and-right direction in the drawing (the main scan direction) substantially orthogonal to a conveyance direction (the sub-scan direction) of the recording medium W by non-illustrated driving means along guide rails 205 installed along a width direction of the recording medium W.

The head 1 horizontally scans and moves on the surface of the recording medium W with movement of the carriage 204 in the main scan direction, and ejecting the liquid droplets from the nozzles 12 in this scanning and moving process enables performing desired printing.

In this liquid droplet ejection apparatus 200, both lateral sides of the recording medium W are non-print regions in which no print data is provided and printing based on the print data is not performed. In the non-print regions, ink receivers 206 are arranged at positions facing the nozzle surfaces of the head 1. Therefore, at the time of performing the flushing operation when the head 1 reaches the non-print region, the liquid droplets are ejected toward the ink receivers 206. In case of installing the liquid droplet speed detection apparatus 3 shown in FIG. 10, this apparatus can be arranged at any position in each of the non-print regions on both sides of the recording medium W.

In the head 1 explained above, the ejection energy giving means in which each partition wall 14 between the neighboring ink chambers 11, 11 is formed of a piezoelectric partition wall 14 and which ejects the ink in the ink chambers 11 as liquid droplets from the nozzles 12 by a deforming operation of each partition wall 14 has been described as the example, but a specific structure of the ejection energy giving means for ejecting the ink in the ink chamber from the nozzle is out of the question. For example, a heater may be provided in the ink chambers as the ejection energy giving means, air bubbles may be generated in the ink by energizing the heater, and the liquid droplets may be ejected from the nozzles by a breaking function of the air bubbles, or one wall surface of the ink chamber may be formed of a diaphragm as the ejection energy giving means, this diaphragm may be vibrated by a deforming operation of the piezoelectric element, the ink in the ink chamber may be given the ejection energy, and the liquid droplets may be ejected from the nozzles.

Moreover, the head 1 is not restricted to a head in which nozzle surfaces are arranged to be vertically downward directed, and nozzle surfaces may be arranged in a horizontal direction or an oblique direction.

EXAMPLES

Example 1

As shown in FIG. 14, a scan type liquid droplet ejection apparatus having ink receivers arranged in non-print regions on both lateral sides of a recording medium was used, predetermined printing was performed in a print region of the recording medium from each head of five colors using UV inks containing a dispersion medium and yellow, magenta, cyan, black and white pigment particles as solid particles, a flushing operation was performed when the head reached the non-print region in order to turn back at an end portion in a main scan direction, and liquid droplets were ejected into each ink receiver.

Ink chambers (nozzles) in the head of each color formed a one-column head aligned in one X direction alone. At the time of the flushing operation, an amount of liquid droplets ejected from the ink chambers (10 chambers in total), each pair of which was placed at each of both end portions in an alignment direction of the ink chambers in the head of each color, was set to be six times an amount of liquid droplets ejected from the respective ink chambers in the central portion.

As a result, even though the operation was continuously performed for 60 hours or more, nozzle clogging did not occur, and the stable operation was possible.

Comparative Example 1

The continuous operation was performed under the same conditions as those in Example 1 except that amounts of liquid droplets ejected from the respective ink chambers at the time of the flushing operation were unified to be the same as the amount of liquid droplets ejected form the ink chambers in the central portion in Example 1.

As a result, nozzle clogging occurred in an ink chamber at the end portion when five hours passed from the operation.

Example 2

As shown in FIG. 3, a line type liquid droplet ejection apparatus that performs printing on a surface of each ceramic tile conveyed by a conveyance belt in one pass was used, predetermined printing was performed in a print region on the surface of the ceramic time from each head of four colors using oil inks containing a dispersion medium and yellow, cyan, brown, and light brown pigment particles as solid particles, a flushing operation was performed when the head reached a non-print region between the ceramic tiles, and liquid droplets were ejected onto the conveyance belt in the non-print region.

Ink chambers (nozzles) in the head of each color formed a one-column head aligned in one X direction alone. At the time of the flushing operation, an amount of liquid droplets ejected from the ink chambers (eight chambers in total), each pair of which was placed at each of both end portions in an alignment direction of the ink chambers in the head of each color, was set to be three times an amount of liquid droplets ejected from the respective ink chambers in the central portion.

As a result, even though the operation was continuously performed for 60 hours or more, nozzle clogging did not occur, and the stable operation was possible.

Comparative Example 2

The continuous operation was performed under the same conditions as those in Example 2 except that amounts of liquid droplets ejected from the respective ink chambers at the time of the flushing operation were unified to be the same as the amount of liquid droplets ejected from the ink chambers in the central portion in Example 2.

As a result, nozzle clogging occurred in an ink chamber at the end portion when five hours passed from the operation.

The entire disclosure of Japanese Patent Application No. 2013-131602, filed on Jun. 24, 2013 including description, claims, drawing, and abstract are incorporated herein by reference in its entirety. Although various exemplary embodiments have been shown and described, the invention is not limited to the embodiments shown. Therefore, the scope of the invention is intended to be limited solely by the scope of the claims that follow.

EXPLANATIONS OF LETTERS OR NUMERALS

1: Head
11: ink chamber
11*a*: ink chamber placed in a central portion
11*b*: ink chamber placed at end portions
12: nozzle
13: common ink chamber
14: partition wall
2: conveyance belt
2*a*: conveyance surface
3: liquid droplet speed detection apparatus
31: light projection unit
32: light reception unit
4: ink tank
41: supply pipe
42: return pipe
43: circulation pump
100: liquid droplet ejection apparatus
101: CPU
102: print data memory
103: encoder
104: belt conveyance motor
105: head driver
106: flushing control unit (flushing device)
200: liquid droplet ejection apparatus
201: a pair of conveyance rollers
202: conveyance motor
203: conveyance roller
204: carriage
205: guide rail
206: ink receivers
P1: ejection pulse
P2: ejection pulse
C: ceramic tile
S: solid particle
L: detection light
W: recording medium
a: liquid droplet

The invention claimed is:

1. A liquid droplet ejection apparatus comprising a head in which a plurality of ink chambers to which an ink is supplied are aligned in one or both of an X direction and a Y direction, each of the ink chamber comprising a nozzle structured to eject liquid droplets from the ink chamber, and wherein the apparatus is structured to carry out printing in a print region of a recording medium based on print data, wherein the ink contains a dispersion medium and solid particles having higher specific gravity than that of the dispersion medium, and wherein the liquid droplet ejection apparatus is structured to be alternately fed with a print region where printing based on data is carried out and a non-print region where printing based on data is not carried out while a printing operation is performed on a recording medium;

the liquid droplet ejection apparatus comprises a flushing device that is structured to perform a flushing operation for continuously ejecting liquid droplets from the nozzles when the head is present in the non-print region, the flushing operation comprising applying one set of pulse applying operations for continuously applying an ejection pulse, and the pulse applying operations are concurrently performed at least once on the nozzle placed at an end portion in an alignment direction and the nozzle placed in a central portion in the alignment direction in such a manner that an amount of liquid droplets ejected from the nozzle placed at an end portion in an alignment direction is larger than an amount of liquid droplets ejected from the nozzle placed in a central portion in the alignment direction, and wherein the flushing operation ejects ink containing solid particles that were sedimented in the ink chambers.

2. The liquid droplet ejection apparatus according to claim 1, wherein, as the difference in the specific gravity between the solid particles and the dispersion medium used in the ink in the head rises, the flushing device increases any one or both of an amount of liquid droplets ejected from the nozzles by the flushing operation and a frequency of performing the flushing operation beyond that when the specific gravity is small, wherein specific gravity is defined as ratio of density of a substance to density of water at 4° C. and atmospheric pressure.

3. The liquid droplet ejection apparatus according to claim 2, wherein the head is formed of a plurality of heads having different types of the inks, and the flushing device increases any one or both of an amount of liquid droplets ejected from the nozzles by the flushing operation and a frequency of performing the flushing operation in the head that uses an ink having the higher specific gravity of the solid particles relative to the dispersion medium beyond the head that uses an ink having the lower specific gravity in the plurality of heads.

4. The liquid droplet ejection apparatus according to claim 1, comprising a liquid droplet speed detection device that detects a speed of the liquid droplets ejected from the nozzles, wherein the flushing device starts the flushing operation after detecting that a detection result of the liquid droplet speed detection device falls below a preset threshold value.

5. The liquid droplet ejection apparatus according to claim 1, comprising a liquid droplet speed detection device that detects a speed of the liquid droplets ejected from the nozzles, wherein the flushing device adjusts an amount of liquid droplets ejected from the nozzles by the flushing operation in accordance with a detection result of the liquid droplet speed detection device.

6. The liquid droplet ejection apparatus according to claim 1, wherein the flushing device increases the amount of liquid droplets ejected from the nozzle placed at the end portion in the alignment direction based on the flushing operation by one or both of increasing the number of liquid droplets ejected from the nozzles and increasing a volume of each of the liquid droplets ejected from the nozzles.

7. The liquid droplet ejection apparatus according to claim 1, comprising:

an ink tank that stores the ink that is supplied to the head; and a circulation device that circulates the ink between the head and the ink tank, wherein the circulation device circulates the ink during a period that at least the flushing operation is performed.

8. The liquid droplet ejection apparatus according to claim 1, wherein a specific gravity difference between the dispersion medium and the solid particles in the ink is 0.2 or more.

9. The liquid droplet ejection apparatus according to claim 1, wherein the ink does not volatilize from the nozzles by drying.

10. A method for recovering a nozzle of a liquid droplet ejection apparatus comprising a head in which a plurality of ink chambers to which an ink is supplied are aligned in one or both of an X direction and a Y direction, liquid droplets are ejected from nozzles provided in accordance with the ink chambers, and printing is carried out in a print region of a recording medium based on print data, wherein the ink contains a dispersion medium and solid particles having higher specific gravity than that of the dispersion medium, wherein while a printing operation is performed on a recording medium, a print region where printing based on print data is carried out and a non-print region where printing based on print data is not carried out are alternately fed to the liquid droplet ejection apparatus, and the method comprises a flushing process of performing a flushing operation for continuously ejecting liquid droplets from the nozzles when the head is present in a non-print region where the printing is not performed, the flushing process comprises applying one set of pulse applying operations comprising continuously applying an ejection pulse, and the pulse applying operations are concurrently performed at least once on a nozzle placed at an end portion in an alignment direction and a nozzle placed in a central portion in the alignment direction in such a manner that an amount of liquid droplets ejected from the nozzle placed at the end portion in an alignment direction becomes larger than an amount of liquid droplets ejected from the nozzle placed in the central portion in the alignment direction, and wherein the flushing operation ejects ink containing solid particles that were sedimented in the ink chambers.

11. The liquid droplet ejection apparatus according to claim 2, wherein, as specific gravity of the solid particles relative to the dispersion medium in the ink used in the head rises, the flushing device increases an amount of liquid droplets ejected from the nozzles by the flushing operation beyond that when the specific gravity is small.

12. The liquid droplet ejection apparatus according to claim 1, wherein the same number the pulse applying operations are performed on the nozzle placed at the end portion and the nozzle placed in the central portion.

13. The method for recovering a nozzle of a liquid droplet ejection apparatus according to claim 10, wherein, in the flushing process, as the difference in the specific gravity between the solid particles and the dispersion medium used in the ink in the head rises, any one or both of an amount of liquid droplets ejected from the nozzles by the flushing operation and a frequency of performing the flushing operation are increased, wherein specific gravity is defined as ratio of density of a substance to density of water at 4° C. and atmospheric pressure.

14. The method for recovering a nozzle of a liquid droplet ejection apparatus according to claim 13, wherein the head is formed of a plurality of heads having different types of the inks, and the flushing process is configured to increase any one or both of an amount of liquid droplets ejected from the nozzles by the flushing operation and a frequency of performing the flushing operation in the head that uses an ink having the higher specific gravity of the solid particles relative to the dispersion medium beyond the head that uses an ink having the lower specific gravity in the plurality of heads.

15. The method for recovering a nozzle of a liquid droplet ejection apparatus according to claim 10, comprising a liquid droplet speed detection process configured to detect a speed of the liquid droplets ejected from the nozzles, wherein, in the flushing process, the flushing operation is started after detecting that a detection result of the liquid droplet speed detection process falls below a preset threshold value.

16. The method for recovering a nozzle of a liquid droplet ejection apparatus according to claim 10, comprising a liquid droplet speed detection process configured to detect a speed of the liquid droplets ejected from the nozzles, wherein, in the flushing process, an amount of liquid droplets ejected from the nozzles by the flushing operation is adjusted in accordance with a detection result of the liquid droplet speed detection process.

17. The method for recovering a nozzle of a liquid droplet ejection apparatus according to claim 10, wherein, in the flushing process, the amount of liquid droplets ejected from the nozzle placed at the end portion in the alignment direction based on the flushing operation is increased by one or both of increasing the number of liquid droplets ejected from the nozzles and increasing a volume of each of the liquid droplets ejected from the nozzles.

18. The method for recovering a nozzle of a liquid droplet ejection apparatus according to claim 10, the apparatus comprising an ink tank that stores the ink that is supplied to the head, wherein the ink is circulated between the ink tank and the head during a period that at least the flushing operation is performed.

19. The method for recovering a nozzle of a liquid droplet ejection apparatus according to claim 10, wherein a specific gravity difference between the dispersion medium and the solid particles in the ink is 0.2 or more.

20. The method for recovering a nozzle of a liquid droplet ejection apparatus according to claim 10, wherein the ink does not volatilize from the nozzles by drying.

* * * * *